US006193352B1

(12) United States Patent
Sharma et al.

(10) Patent No.: US 6,193,352 B1
(45) Date of Patent: Feb. 27, 2001

(54) METHOD FOR CLEANING AN INK JET PRINT HEAD

(75) Inventors: Ravi Sharma, Fairport; Vincent E. Hamilton-Winbush, Rochester; Thomas L. Penner, Fairport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/204,600

(22) Filed: Dec. 3, 1998

(51) Int. Cl.[7] ..... B41J 2/165
(52) U.S. Cl. ..... 347/28; 347/45
(58) Field of Search ..... 347/28, 45; 143/42, 143/2

(56) References Cited

U.S. PATENT DOCUMENTS 4,918,198 * 4/1990 Anderson et al. ..... 548/550
4,964,919 * 10/1990 Payne ..... 134/2
5,143,758 * 9/1992 Devine ..... 427/420
5,300,958 * 4/1994 Burke et al. ..... 347/33
5,495,272 2/1996 Yamaguchi .
5,589,865 12/1996 Beeson .
5,786,832 * 7/1998 Yamanaka et al. ..... 347/45
5,825,380 * 10/1998 Ichizawa et al. ..... 347/28
6,031,022 * 2/2000 Martin et al. ..... 523/161

FOREIGN PATENT DOCUMENTS

411263021 * 9/1999 (JP) .

* cited by examiner

*Primary Examiner*—David F. Yockey
*Assistant Examiner*—Michael S Brooke
(74) *Attorney, Agent, or Firm*—Harold E. Cole

(57) ABSTRACT

A method for cleaning an ink jet print head nozzle plate having an anti-wetting layer formed thereon, wherein an aqueous solution of a metal salt of a taurine surfactant is applied to the nozzle plate and then removed.

5 Claims, No Drawings

METHOD FOR CLEANING AN INK JET PRINT HEAD

FIELD OF THE INVENTION

This invention relates to ink jet printing and, more particularly, to a method for cleaning ink jet nozzle plates in ink jet print heads by maintaining the anti-wetting character thereof.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

A continuing problem with ink jet printers is the accumulation of ink on ink jet nozzle plates, particularly around the orifice from which ink drops are ejected. The result of ink drops accumulating around the orifice is that it becomes wettable causing ink drops to be misdirected, degrading the quality of the printed image.

To limit or prevent the spreading of ink from the orifice to the nozzle plate, it is common practice to coat the ink jet nozzle plate with an anti-wetting layer. Examples of anti-wetting layers are coatings of hydrophobic polymer materials such as Teflon® and polyimide-siloxane, or a monomolecular layer of a material that chemically binds to the nozzle plate, e.g., alkyl thiols, alkyl trichlorosilanes and partially fluorinated alkyl silanes.

Ink jet nozzle plates are also contaminated by ink drops that land on the nozzle plate. These "satellite" ink drops are created as a by-product of the drop separation process of the primary ink drop that is used to print. Another source of contaminating ink are tiny ink drops that are created when the primary ink drop impacts recording material. Ink drops accumulating on the nozzle plate can also potentially attract contaminants such as paper fibers which cause the nozzles to become blocked. Partially or completely blocked nozzles can lead to missing or misdirected drops on the print media, either of which degrades the quality of the print.

In order to solve this problem, the nozzle plates are periodically wiped clean. Several wiping methods are known including wet wiping techniques utilizing inks as a cleaning solvent. While inks and ink solvents used to dilute inks may be used as a cleaning liquid, they are not optimized for this purpose. Inks may contain additives such as, for example, ethylene glycol, diethylene glycol, and diethylene glycol monobutyl ether which may be environmentally undesirable when released during cleaning in unventilated areas such as a home or an office.

Further, inks often contain various materials which may leave an undesirable residue on the ink jet print head nozzle plate. Thus while wiping removes ink drops from the nozzle plate, the hydrophobic anti-wetting coating on the nozzle plate may be severely contaminated and compromised by ink residue. The ink-fouled coating is therefore unable to prevent the spreading of ink from orifices.

It has also been discovered that hydrophobic coatings on an ink jet print head nozzle plate are susceptible to fouling by certain ink jet inks, such as those containing copper phthalocyanine dyes. The fouling of the nozzle plate by the ink can lead to excessive spreading by ink on to the nozzle plate during normal use, further aggravating drop placement problems. Another disadvantage in using inks as a cleaning solution is that they are expensive.

There remains a need for a simple, economical ink jet nozzle plate cleaning solution that will help maintain the anti-wetting character of ink jet nozzle plates so that an ink jet print head will consistently deliver accurate and reproducible drops of ink to a receiver resulting in photographic quality images.

DESCRIPTION OF RELATED ART

U.S. Pat. Nos. 5,495,272 and 5,589,865 relate to a cleaning solution for an ink jet print head which may include a surfactant. However, there is a problem in that not all surfactants are as effective in cleaning as one would like.

SUMMARY OF THE INVENTION

In accordance with the present invention, there is provided a method for cleaning an ink jet print head nozzle plate comprising applying to said nozzle plate a cleaning solution comprising an aqueous solution of a metal salt of a taurine surfactant.

A taurine surfactant has a hydrophobic moiety and a polar taurine moiety and may be represented by the following formula:

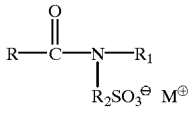

wherein

R represents a substituted or unsubstituted alkyl or arylalkyl group having from about 6 to about 22 carbon atoms or a fluoroalkyl or arylfluoroalkyl group having from about 4 to about 14 carbon atoms, such as hexyl, dodecyl, myristyl, lauryl, oleoyl, dodecylbenzene, fluorobutyl, fluorohexyl, phenylperfluorohexyl, partially fluorinated alkyl groups, etc.;

$R_1$ and $R_2$ each independently represents a substituted or unsubstituted alkyl or fluoroalkyl group having from about 1 to about 6 carbon atoms, such as methyl, ethyl, propyl, fluoromethyl, fluoroethyl, partially fluorinated alkyl groups, etc; and $M^+$ represents either a metal ion such as sodium, potassium, magnesium, etc.; or an ammonium ion.

The cleaning liquid used in this invention is inexpensive, odor-free and non-toxic. This cleaning solution is effective in restoring the anti-wetting property of coatings on an ink jet printhead after the surface of the print head has been fouled by ink.

In a preferred embodiment of the invention, R is myristyl, lauryl or oleoyl. In another preferred embodiment, $R_1$ is methyl and $R_2$ is ethyl. In yet another preferred embodiment, $M^+$ represents sodium.

Examples of surfactants useful in the invention include the following:

Surfactant 1: oleoyl methyl taurate, sodium salt (NaOMT);

Surfactant 2: lauryl methyl taurate, sodium salt (NaLMT); or

Surfactant 3: myristyl methyl taurate, sodium salt (NaMMT).

Ink jet inks used in ink jet recording elements which the cleaning solution of the present invention will clean are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Ink jet nozzle plates which the cleaning solution of the present invention will clean are well known in the art. They are disclosed, for example, in U.S. Pat. Nos. 5,574,485; 5,250,962; 5,117,244; and 5,304,814, the disclosures of which are hereby incorporated by reference.

The following examples are provided to illustrate the invention.

EXAMPLES

Example 1—Cleaning Experiment on Teflon® AF Test Surface Using Surfactants 1–3

An adhesion-promoting layer of 1H,1H,2H-perfluorodecyltriethoxysilane (PFDT) (Lancaster Co.) was deposited on a silicon wafer by spin coating in the following manner: A 5% solution of PFDT in Fluorad® FC-75 fluorocarbon surfactant (3M Corp.) was pipetted on a silicon wafer and spun at 5,000 RPM for 40 seconds. The coating was then baked at 110° C. for 10 min., resulting in a 140 nm thick coating.

A 6% solution of Teflon® AF (DuPont Corp.) was prepared in perfluorinated solvent C5-18 (DuPont Corp.) and spin coated onto the PFDT coated wafer at 2,800 RPM and then baked for 35 min following a temperature ramp from 50° C. to 330° C. The thickness of the Teflon® AF layer was 360 nm thick. (A Teflon® AF surface is representative of a hydrophobic anti-wetting coating that is applied to an ink jet nozzle plate to limit spreading of ink on the nozzle plate.) The Teflon® AF coated wafer sample was then cut into several pieces and subjected to an ink fouling and cleaning procedure described below.

The contact angle of water on the coated wafer was measured and recorded in Table 1. A drop (1–2 mm diameter) of distilled, deionized water was placed on a test surface. The contact angle of the water drop with the test surface was measured using either a contact angle measuring apparatus G-2 obtained from Krüss (U.S.A.) or a contact angle goniometer obtained from Rame-Hart.

A piece of coated wafer was then dipped into an aqueous-based test ink composed of 2 wt % copper phthalocyanine tetrasulfonic acid tetrasodium salt (Acros Organics) and 10 wt % ethylene glycol (Aldrich Chemical Co. Inc.) This ink is representative of soluble dye-based inks that use sulfonated copper phthalocyanines. The sample was removed 5 minutes later and rinsed in distilled and deionized water. The water contact angle was then measured again and recorded in Table 1.

The samples were then dipped into a 34 mM Surfactant 1 aqueous solution in order to test for decontamination by that surfactant. The sample was removed 5 minutes later and rinsed in distilled, deionized water and dried in a stream of filtered nitrogen. The contact angle was then measured again and recorded in Table 1.

The above procedure was repeated for Surfactants 2 and 3. The following results were obtained:

TABLE 1

| Water Contact Angle (°) | | | | |
|---|---|---|---|---|
| Initial | After Ink Test | After Surfactant 1 Treatment | After Surfactant 2 Treatment | After Surfactant 3 Treatment |
| 113 | 88 | 114 | 119 | 111 |

The above results show that treatment of the ink-fouled test surface with a surfactant in accordance with the invention substantially restored the contact angle to its initial value.

Example 2—Cleaning Experiment on Ink Jet Nozzle Plate

An ink jet print head nozzle plate was coated with Teflon® AF (300 nm thick) as in Example 1 and subjected to the ink-fouling and subsequent cleaning procedure of Example 1 using Surfactants 1 and 2. The results are listed in the following Table:

TABLE 2

| Water Contact Angle (°) | | | |
|---|---|---|---|
| Initial | After Ink Test | After Surfactant 1 Treatment | After Surfactant 2 Treatment |
| 112 | 71 | 109 | 111 |

The above results show that the cleaning test on an actual ink jet nozzle plate correlates well with the test surface of Example 1.

Example 3—Cleaning Test with Different Concentrations of Surfactant 1

Example 1 was repeated using a range of Surfactant 1 concentrations as listed in Table 3. The following results were obtained:

TABLE 3

| Water Contact Angle (°) | | | | |
|---|---|---|---|---|
| Initial | After Ink Test | After 0.4 mM Surfactant 1 Treatment | After 8.6 mM Surfactant 1 Treatment | After 51.3 mM Surfactant 1 Treatment |
| 113 | 88 | 109 | 107 | 116 |

The above results show that treatment of the ink-fouled test surface with different concentrations of Surfactant 1 substantially restored the contact angle to its initial value.

Example 4—Cleaning Experiment on Polyimide-siloxane Test Surface

A hydrophobic coating of a copolymer of polyimide-siloxane or PI-PDMS was prepared by spin coating. The polyimide-siloxane had a molecular weight of 100,000 daltons and had a polydimethysiloxane content of 20 wt. %.

A 7% solution of PI-PDMS in 1,2,3-trichloropropane was filtered and dripped on to a silicon wafer spinning at 3,000 RPM. The sample was then dried at 110° C. for 5 minutes. The PI-PDMS coating was 500 nm thick and had a water contact angle of 96°. The PI-PDMS coating is representative of another hydrophobic anti-wetting coating that is applied to an ink jet nozzle plate to limit spreading of ink on the nozzle plate. The coated sample was diced into conveniently sized pieces and subjected to the ink fouling and cleansing procedures described in Example 1. The following results were obtained:

TABLE 4

| Water Contact Angle (°) | | | | |
|---|---|---|---|---|
| Initial | After Ink Test | After Surfactant 1 Treatment | After Surfactant 2 Treatment | After Surfactant 3 Treatment |
| 96 | 68 | 92 | 95 | 95 |

The above results show that treatment of the ink-fouled test surface with a taurine surfactant according to the invention substantially restored the contact angle to its initial value.

Example 5—Cleaning Test with Different Concentrations of Surfactant 1

Example 4 was repeated using a range of surfactant 1 concentrations as listed in Table 5. A control surfactant of C-1 of sodium dodecyl sulfate (Eastman Kodak Co.), a non taurine surfactant, was also used in this example at 4 mM. The following results were obtained:

TABLE 5

| Water Contact Angle (°) | | | | | |
|---|---|---|---|---|---|
| Initial | After Ink Test | After 0.4 mM Surfactant 1 Treatment | After 1.2 mM Surfactant 1 Treatment | After 34 mM Surfactant 1 Treatment | After 4 mM Control Surfactant C-1 |
| 96 | 68 | 93 | 92 | 92 | 71 |

The above results show that treatment of the ink-fouled test surface with different concentrations of surfactant 1 substantially restored the contact angle to its initial value. The control surfactant was not as effective as the taurine surfactant employed in the invention.

Example 6—Cleaning Experiment on Plasma-deposited Fluorinated Test Surface

A hydrophobic coating of fluorinated polymer was deposited on silicon wafer using a Plasma-Therm 70 series plasma deposition system under the following conditions. The RF power level was set at 200W. Trifluoromethane ($CHF_3$) gas pressure was 350 mTorr and the flow rate of the gas was 50 sccm. The silicon substrate was exposed to the $CHF_3$ plasma for 10 min. The resulting coating was 200 nm thick and had a water contact angle of 99°. The plasma deposited coating is representative of a hydrophobic anti-wetting coating that may be applied to an ink jet nozzle plate to limit spreading of ink on the nozzle plate. The coated sample was diced into conveniently sized pieces and subjected to the ink fouling and cleansing procedures described in Example 1. The following results were obtained:

TABLE 6

| Water Contact Angle (°) | | | | |
|---|---|---|---|---|
| Initial | After Ink Test | After Surfactant 1 Treatment | After Surfactant 2 Treatment | After Surfactant 3 Treatment |
| 99 | 68 | 93 | 95 | 95 |

The above results show that treatment of the ink-fouled test surface with a taurine surfactant according to the invention substantially restored the contact angle to its initial value.

Example 7—Cleaning Test with Different Concentrations of Surfactant 1

Example 6 was repeated using a range of surfactant 1 concentrations as listed in Table 3. The following results were obtained:

TABLE 7

| Water Contact Angle (°) | | | | |
|---|---|---|---|---|
| Initial | After Ink Test | After 0.4 mM Surfactant 1 Treatment | After 1.2 mM Surfactant 1 Treatment | After 34 mM Surfactant 1 Treatment |
| 99 | 88 | 94 | 94 | 92 |

The above results show that treatment of the ink-fouled test surface with different concentrations of surfactant 1 substantially restored the contact angle to its initial value.

Example 8—Cleaning Experiment on Plasma-deposited Fluorinated Test Surface

Example 6 was repeated except that the thickness of the fluorinated test surface was 50 nm. The surfactants tested were Surfactant 1 and a control surfactant C-2 of cetyl trimethyl ammonium bromide (Eastman Kodak Co.) at 4 mM. The following results were obtained:

TABLE 8

| Surfactant | Water Contact Angle (°) | | |
|---|---|---|---|
| | Initial | After Ink Test | After Treatment |
| 1 (34 mM) | 103 | 51 | 93 |
| Control C-2 (4 mM) | 103 | 43 | 63 |

The above results show that treatment of the ink-fouled test surface with a taurine surfactant significantly restored the contact angle as compared to the control surfactant C-2.

Although the invention has been described in detail with reference to certain preferred embodiments for the purpose of illustration, it is to be understood that variations and modifications can be made by those skilled in the art without departing from the spirit and scope of the invention.

What is claimed is:

1. A method for cleaning an ink jet print head nozzle plate having a surface coated with an anti-wetting layer, said anti-wetting layer having been ink-fouled by contact with an ink jet ink containing a water-soluble dye, said method comprising applying to said coated surface of said nozzle plate a cleaning solution comprising an aqueous solution of a metal salt of a taurine surfactant, and removing said cleaning solution from said surface of said print head.

2. The method of claim 1 wherein said taurine surfactant has the following formula:

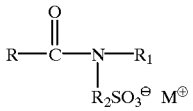

wherein

R represents a substituted or unsubstituted alkyl or arylalkyl group having from about 6 to about 22 carbon atoms or a fluoroalkyl or arylfluoroalkyl group having from about 4 to about 14 carbon atoms;

$R_1$ and $R_2$ each independently represents a substituted or unsubstituted alkyl or fluoroalkyl group having from about 1 to about 6 carbon atoms; and $M^+$ represents either a metal ion or an ammonium ion.

3. The method of claim 2 wherein R is myristyl, lauryl or oleoyl.

4. The method of claim 2 wherein $R_1$ is methyl and $R_2$ is ethyl.

5. The method of claim 2 wherein $M^+$ represents sodium.

* * * * *